US011382437B2

(12) United States Patent
Longenecker et al.

(10) Patent No.: US 11,382,437 B2
(45) Date of Patent: Jul. 12, 2022

(54) ROTATABLE CLIP-ON TABLE SEAT

(71) Applicant: ARTSANA USA, INC., Lancaster, PA (US)

(72) Inventors: Michael L. Longenecker, Lancaster, PA (US); Raymond Evan Good, Lancaster, PA (US); Stephen J. Wood, Kutztown, PA (US)

(73) Assignee: Artsana USA, Inc., Lancaster, PA (US)

( * ) Notice: Subject to any disclaimer, the term of this patent is extended or adjusted under 35 U.S.C. 154(b) by 0 days.

(21) Appl. No.: 17/392,896

(22) Filed: Aug. 3, 2021

(65) Prior Publication Data

US 2022/0117407 A1 Apr. 21, 2022

Related U.S. Application Data

(60) Provisional application No. 63/093,078, filed on Oct. 16, 2020.

(51) Int. Cl.
*A47D 1/10* (2006.01)

(52) U.S. Cl.
CPC ..... *A47D 1/106* (2013.01)

(58) Field of Classification Search
CPC ..... A47D 1/106; A47D 1/10
USPC ..... 297/174 CS
See application file for complete search history.

(56) References Cited

U.S. PATENT DOCUMENTS 3,126,226 A 3/1964 Johnson
4,926,722 A 5/1990 Sorensen et al.
6,679,549 B2 1/2004 Catelli
7,651,161 B2 1/2010 Anselmi et al.
8,210,610 B2 7/2012 Berkey et al.
8,297,694 B2 10/2012 Arnold, IV et al.
(Continued)

FOREIGN PATENT DOCUMENTS

CN 2157707 Y * 3/1994 ..... A47D 1/106
CN 101258971 A 9/2008
(Continued)

*Primary Examiner* — Milton Nelson, Jr.
(74) *Attorney, Agent, or Firm* — Saxton & Stump, LLC

(57) ABSTRACT

A rotatable clip-on seat for attachment adjacent an edge of a tabletop comprising a main frame supporting a seat for a child and grip arms extending distally from the seat for positioning atop the table. Moveable clamping arms connect to the main frame and are rotatable about a longitudinal axis between folded and unfolded orientations. When unfolded, the clamping arms extend downwardly from the main frame and forwardly, generally parallel to the grip arms on the underside of the tabletop opposite of the grip arms. User-adjustable clamps connected to the clamping arms include upwardly extendable members to engage the underside of the table to secure the seat frame to the tabletop. The clamps are pivotable about a clamp axis which is parallel to the longitudinal axis to ease installation on the tabletop and to allow frame folding for storage which positions the clamping arms and clamps generally between the grip arms. Extensible member position is adjusted by a selectively releasable ratcheting apparatus conveniently accessible to the user for both ratcheting and releasing operations. The seat may be rotated about an upstanding axis and locked into one of a plurality of orientations to enable user-selectable orientation of the child occupant.

16 Claims, 9 Drawing Sheets

(56) References Cited

U.S. PATENT DOCUMENTS

| | | | | |
|---|---|---|---|---|
| 9,101,227 | B2 | 8/2015 | Zehfuss | |
| 9,993,090 | B2 | 6/2018 | Hsu | |
| 10,051,947 | B2 | 8/2018 | Sisante | |
| 10,136,738 | B2 | 11/2018 | Xu | |
| 10,321,769 | B2 | 6/2019 | Longenecker | |
| 2010/0038936 | A1 | 2/2010 | Gibson et al. | |
| 2017/0280890 | A1* | 10/2017 | Hsu | A47D 1/106 |

FOREIGN PATENT DOCUMENTS

| | | | |
|---|---|---|---|
| CN | 201189019 | Y | 2/2009 |
| CN | 201227068 | Y | 4/2009 |
| CN | 201468675 | U | 5/2010 |
| CN | 202035812 | U | 11/2011 |
| CN | 202354957 | U | 8/2012 |
| CN | 204245718 | U | 4/2015 |
| FR | 2973207 | A1 | 4/2013 |

* cited by examiner

ROTATABLE CLIP-ON TABLE SEAT

CROSS-REFERENCE TO RELATED APPLICATIONS

This application claims the benefit of priority of U.S. Provisional Application 63/093,078 filed Oct. 16, 2020.

BACKGROUND OF THE INVENTION

This invention relates generally to portable seating for small children, and more particularly to a collapsible seat that may be conveniently attached to a table or the like, with a seating portion that can be selectively rotated to face the child in different directions.

Portability of infant care accessories is an increasingly important consideration among consumers. Foldable seat frames that conveniently clamp to a table are well-known in the art, though the majority generally lack the ability to be effectively clamped to a table that includes a substantial downwardly extending skirt or apron proximate to the edge of the table surface. Existing frames that accommodate such installations generally do so with compromises to the compactness and/or ease of use (e.g., attachment to and removal from the table) when they are removed and folded for stowage. Consequently, the need to improve compactness, stability when installed, and ease of use of foldable seat frames is a growing concern. Many benefits would be realized by a foldable seat frame that is conveniently attachable to a table surface, even one including a substantial downwardly extending apron, secure when attached, easily removable, and collapsible into a compact form when removed.

Expanding the utility of table-attached booster seats is also increasingly important to users. Table-attached booster seats allowing child occupants only to face the table to which the seat is attached limit caregiver access to the child, requiring the caregiver to approach the child from over the table.

Numerous benefits would be realized by a rotatable clip-on table seat that is conveniently attachable to a table surface, even one including a substantial downwardly extending apron, secure when attached, easily removable, and collapsible into a compact form when removed. Additional benefits would be realized with a securing mechanism capable of simple, reliable operation that assures a secure connection of the seat to the table. Still further benefits would be realized by a clip-on table seat that is rotatable 360-degrees so that the child could be reoriented to face a user-selected direction.

SUMMARY OF THE INVENTION

Accordingly, the present invention, in any of the embodiments described herein, may provide one or more of the following advantages:

It is an object of the present invention to provide a portable clip-on table seat for attachment to a table surface adjacent an edge of the surface that provides a rotatable seat proximate to the table surface suitable for a young child. The clip-on table seat comprises a main frame that supports a seat for a child and includes grip arms that extend distally from the seat, the grip arms being configured to be positioned atop a surface of a table or other structure to which the foldable seat frame is to be attached. Moveable clamping arms are connected to the main frame and rotatable about a longitudinal axis between folded and unfolded orientations.

When unfolded, the clamping arms are positioned downwardly from the main frame portion and extend forwardly, generally parallel to the grip arms on the underside of the table surface opposite of the grip arms. To the clamping arms are connected user-adjustable clamp members, each having an extensible member that may be extended upwardly to engage the underside of the table and apply pressure thereto to secure the seat frame to the table. The clamp members may be pivoted about a clamp axis that is parallel to the longitudinal axis of the clamping arms to repositioning the clamp members to minimize obstruction with the table when engaging the clip-on seat for use.

It is a further object of the present invention to provide a rotatable clip-on table seat for attachment to a table surface adjacent an edge of the surface that provides a seat proximate to the table surface suitable for a young child wherein the seat orientation may be adjusted by a user so that the child occupant can face any direction, not just the table. Attached to the main frame portion is a seat mount and a seat which permits the seat to rotate 360 degrees about a generally vertical axis while the foldable seat frame is clamped in position to a table or similar supporting surface. The seat and seat mount may further include locking provisions enabling the orientation of the seat to be fixed in one of a plurality of pre-determined orientations, including the child facing the table to which the foldable seat frame is attached.

It is another object of the present invention to provide a rotatable clip-on table seat for attachment to a table surface adjacent an edge of the surface wherein the frame comprises grip arms that extend distally from the seat to be positioned atop a surface of a table or the like to which the foldable seat frame is to be attached and clamping arms extend downwardly from the frame and forwardly and generally parallel to the grip arms on the underside of the table surface opposite of the grip arms. The downward extension of the clamping arms allows them to extend below the bottom edge of any skirt or similar structures that extend downwardly below the bottom surface of the table. The clamping arms feature user-adjustable clamp members each having an extensible member that may be extended upwardly to engage the underside of the table and apply pressure thereto to secure the seat frame to the table. The clamp members may be pivoted about a clamp axis that is parallel to the longitudinal axis of the clamping arms to maximize clearance between the grip arms and clamping arms thereby minimizing obstacles when positioning the clip-on seat on the table for use.

It is a still further object of the present invention to provide a rotatable clip-on table seat for attachment to a table surface adjacent an edge of the surface and clamping arms extend downwardly from the frame and forwardly and generally parallel to the grip arms on the underside of the table surface opposite of the grip arms. The clamping arms feature user-adjustable clamp members with extensible members that may be extended upwardly to engage the underside of the table and apply pressure thereto to secure the seat frame to the table. The extensible members may be extended by a selectively releasable ratcheting apparatus positioned to be conveniently accessible to the user for both ratcheting and releasing operations.

It is a still further object of the present invention to provide a rotatable clip-on table seat for attachment to a table surface adjacent an edge of the surface that provides a seat proximate to the table surface suitable for a young child wherein the seat orientation may be adjusted by a user so that the child occupant can face any direction that is durable in construction, inexpensive of manufacture, carefree of maintenance, easily assembled, and simple and effective to use.

These and other objects are achieved in accordance with the present invention by providing a rotatable clip-on table seat for attachment to a tabletop adjacent to an edge for positioning a young child proximate to the tabletop. The clip-on seat comprises a main frame that supports a seat for a child and includes grip arms that extend distally from the seat to be positioned atop the table. Moveable clamping arms are connected to the main frame and rotatable about a longitudinal axis between folded and unfolded orientations. When unfolded, the clamping arms are positioned downwardly from the main frame portion and extend forwardly, generally parallel to the grip arms on the underside of the table surface opposite of the grip arms. The clamp arms feature user-adjustable clamps with extensible members that may be extended upwardly to engage the underside of the table and apply pressure thereto to secure the seat frame to the table. The user-adjustable clamps may be pivoted about a clamp axis which is parallel to the longitudinal axis to minimize obstructions to positioning the foldable seat frame on the table for use. The folded configuration also positions the clamping arms and clamps generally between the grip arms to minimize necessary storage space. The extensible members may be extended by a selectively releasable ratcheting apparatus positioned to be conveniently accessible to the user for both ratcheting and releasing operations. The seat supported by the frame is configured so that it is rotatable about an upstanding axis and may be locked into one of a plurality of pre-determined orientations to enable a user-selectable orientation of the direction the child faces when in the seat.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Figure 1:
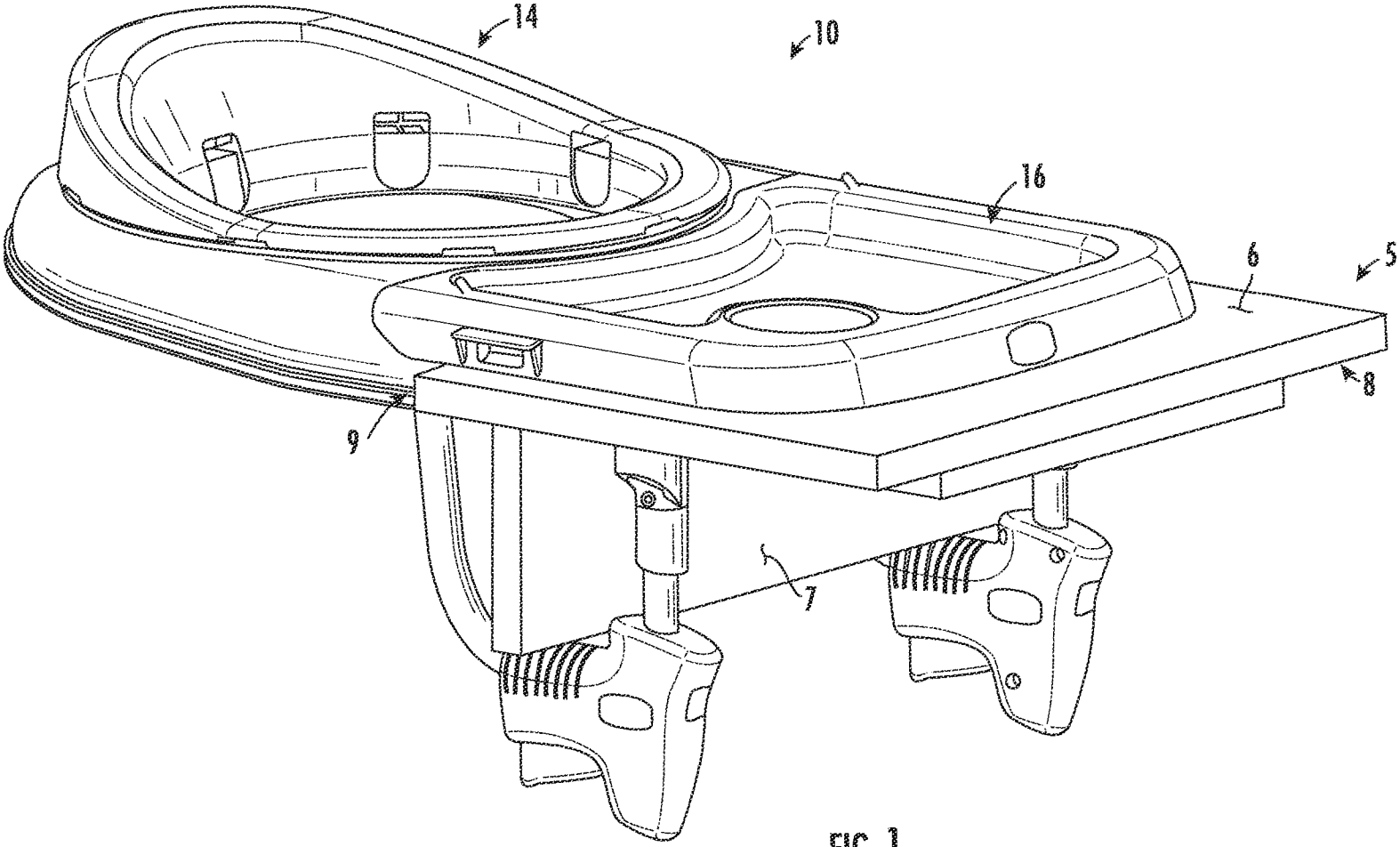
FIG. 1 is a perspective view of a rotatable clip-on table seat for a child shown attached to a conventional table having a downwardly extending apron adjacent to its perimeter.
Figure 2:
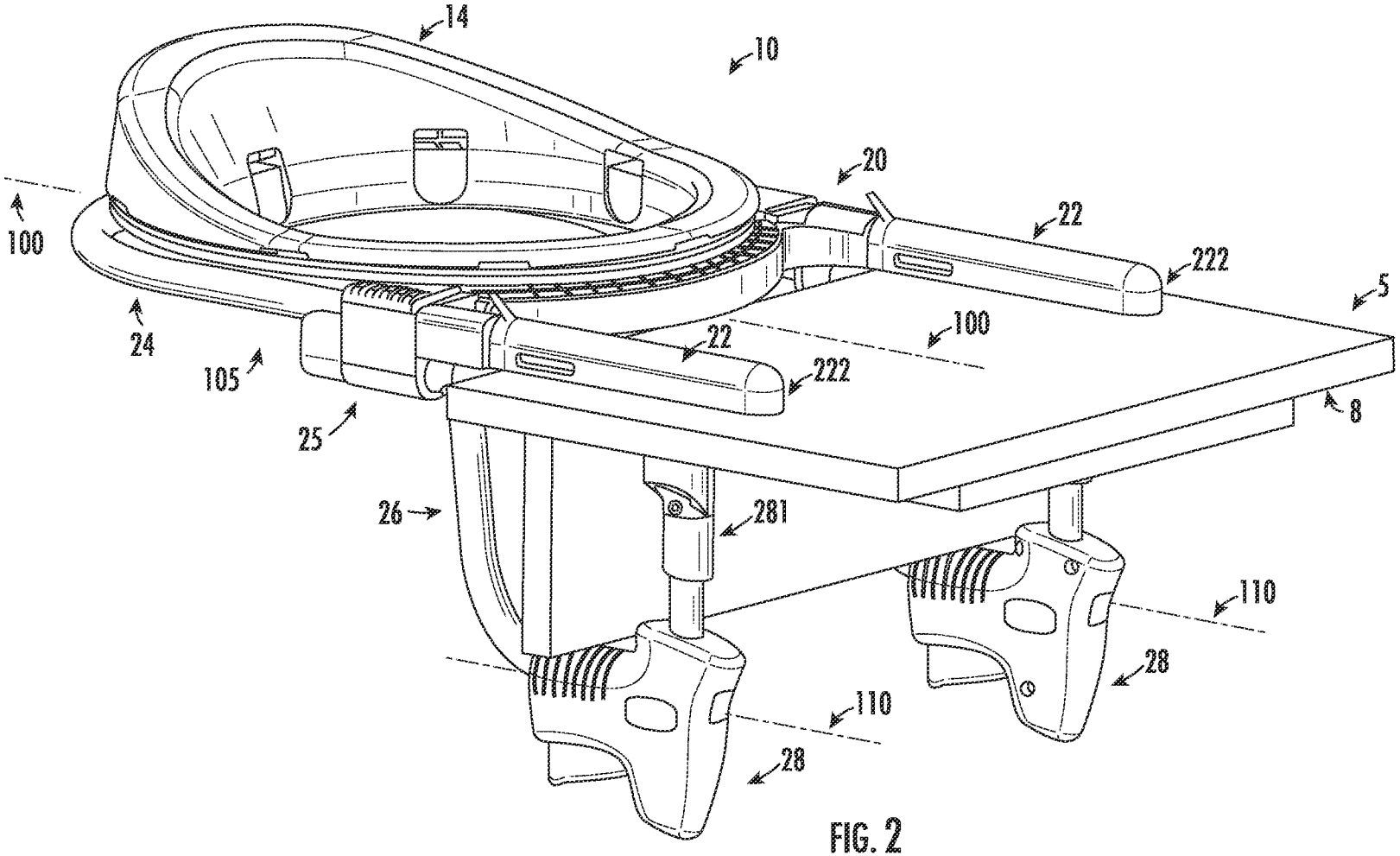
FIG. 2 is a second view of the rotatable clip-on table seat of FIG. 1 shown with some elements hidden to reveal the underlying frame as it would be configured when attached to a table.
Figure 3:
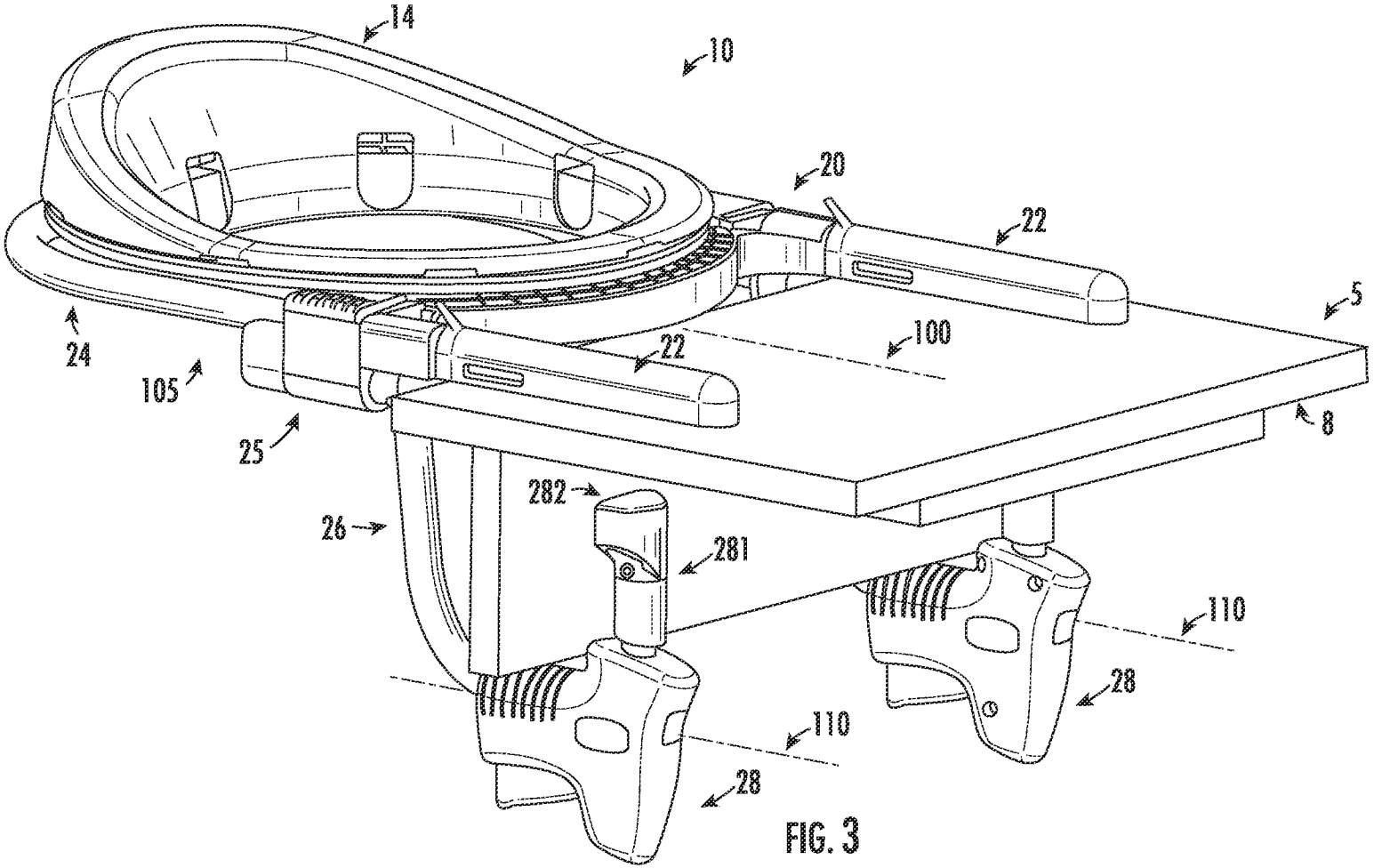
FIG. 3 shows the rotatable clip-on table seat of FIG. 2 as it would be configured for attachment to or in preparation for detachment from the table.

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the clip-on seat would normally be positioned when clamped to a table surface to support a child. Soft goods are not shown in the figures to improve clarity. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Referring to the figures, particularly FIGS. 1 through 5, a rotatable clip-on table seat 10 embodying the aspects of the present invention is shown positioned for use by attachment to a conventional tabletop 5 having an upper surface 6 and a lower surface 8. As is common in table design, the lower surface 8 includes a downwardly extending apron 7 adjacent to an edge 9 of the tabletop. The seat 10 comprises a main frame 20 to which may be connected a child support 14 and a tray 16. The child support 14 may further comprise soft goods suspended from the support 14 to securely restrain a child placed into the seat.

The main frame 20 comprises a main frame 20 which may be generally U-shaped an comprise a pair of grip arms 22 at one end and a seat frame 24 at the opposite end defining a longitudinal axis 100 of the seat frame. The grip arms 22 are designed to be positioned in contact with the upper surface 6 of the tabletop 5 when the seat 10 is installed. The grip arms 22 may include coatings or coverings to increase friction with the table and/or to prevent marring of the table surface. The seat frame 24 includes the U-shaped frame portion and connects to the grip arms 22. The seat frame 24 is designed to cantilever from the edge 9 of the table surface so that a child seated in the seat 10 is positioned adjacent to the table in a manner allowing the child's legs to hang lower than the table upper surface 6. The main frame 20 is preferably aligned in a single plane so that the seat frame 24 is generally supported at the same height as the table for convenience to the caregiver of a child in the seat.

The distal ends 222 of the grip arms 22 may be connected such that the main frame 20 is in the form of an elongated loop or the U-shape of the main frame 20 may be reversed so that the grip arms are joined while the seat frame 24 comprises the leg portions of the U-shape.

The main frame 20 also comprises a pair of clamping arms 26 that are moveably connected to the main frame 20 by a pair of connectors 25. The clamp frames are moveable about respective folding axes 105 that are parallel to the longitudinal axis 100 between a deployed position for use (FIGS. 2 through 4) and a folded position (FIG. 5) which reduces the space require to stow the seat when it is not in use by positioning the clamping arms substantially between the grip arms. When deployed, the clamping arms 26 extend downwardly from the plane of the main frame and forwardly to a position generally below respective grip arms 22. Biased detents, such as a spring ball mechanism or the like, may be provided to urge the clamping arm 26 into one of either the unfolded (deployed) or folded (storage) positions to reduce unintentional movement from the selected configuration.

Figure 4:
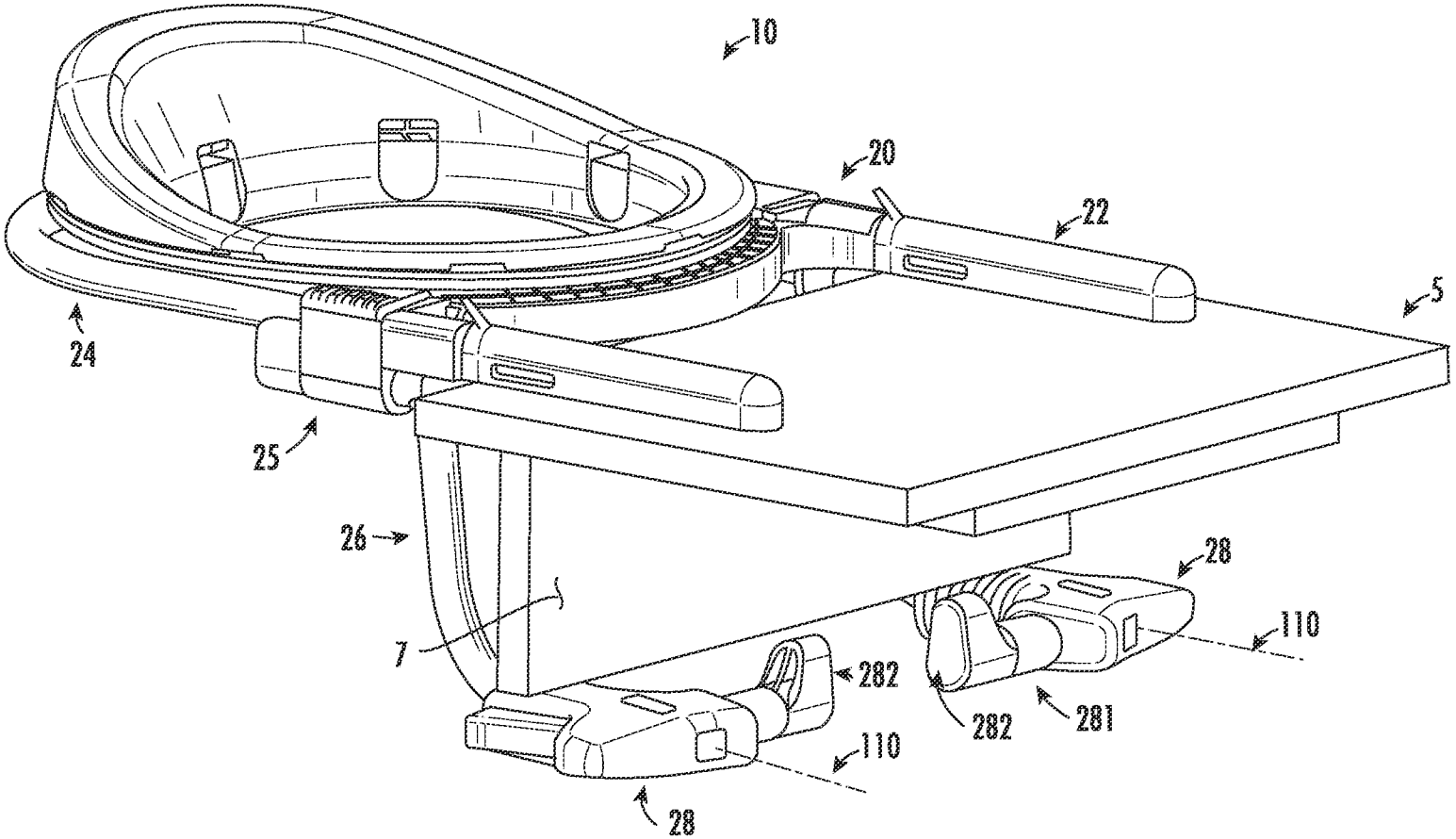
FIG. 4 shows the rotatable clip-on table seat of FIG. 2 wherein moveable grip arms disposed on the clamping arms are rotated to ease removal or installation of the foldable seat frame on the table.
Figure 5:
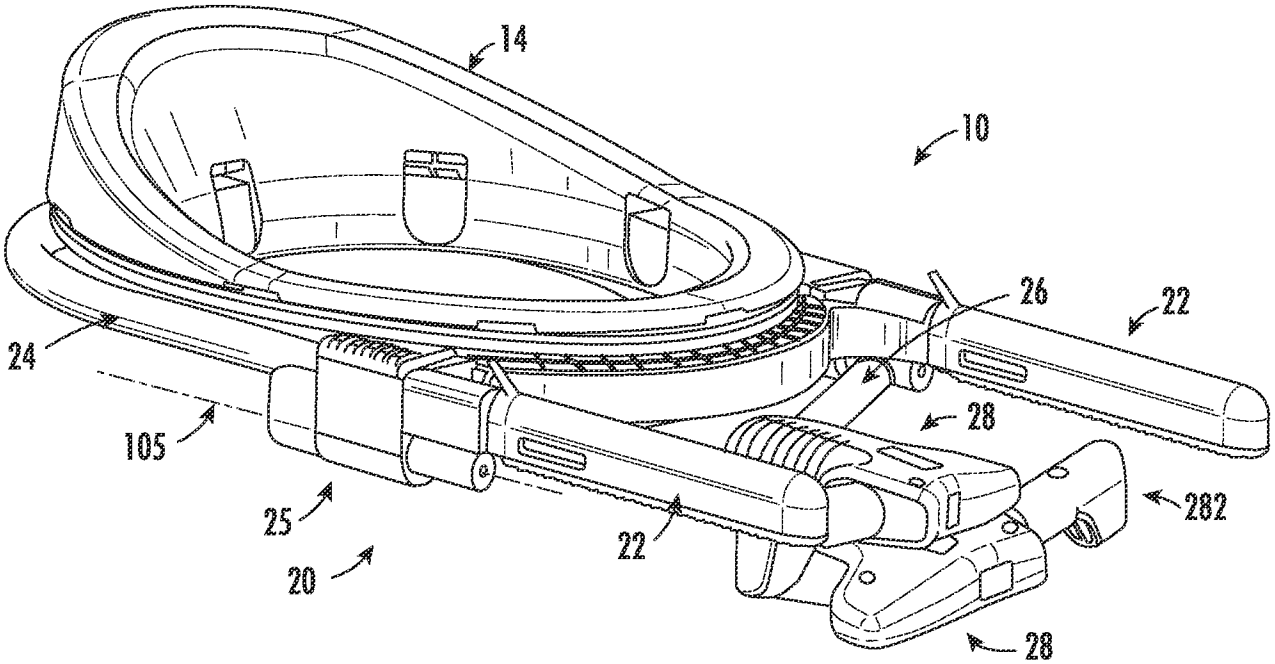
FIG. 5 is an elevation view of the rotatable clip-on table seat shown folded for storage.

A clamp member 28 is located at the distal end of each clamping arm opposite from the connector 25. Each clamp member 28 is rotatable about an axis of the clamp frame 110 between a clamping orientation (FIG. 2) and a removal orientation (FIG. 4). Each clamp member 28 further comprises an extensible member 281 moveable generally perpendicularly to the axis of the clamp frame 110 between generally opposing engaged (FIG. 2) and disengaged (FIG. 3) positions. A gripping foot 282 is provided at the distal end of the extensible member 281 to engage the lower surface 8 of the table and minimize slipping when so engaged.

Figure 6:
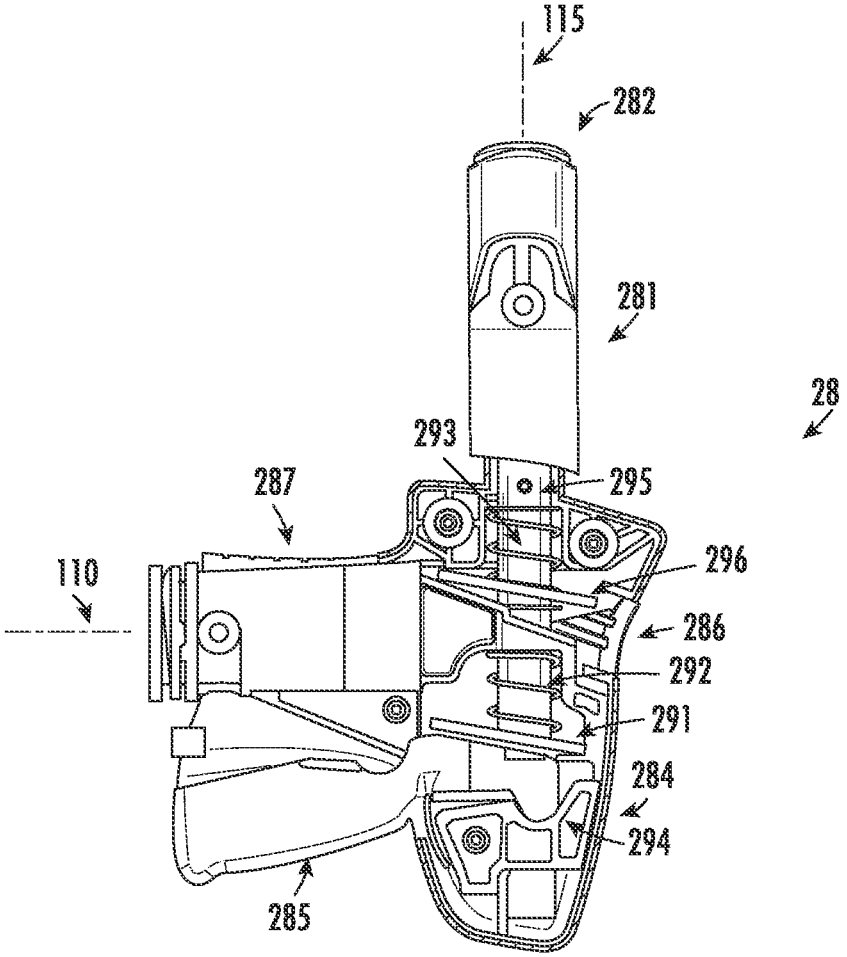
FIGS. 6 through 8 provide partial views of the grip arm internal mechanism that is used to secure the foldable seat frame to the table.
Figure 7:
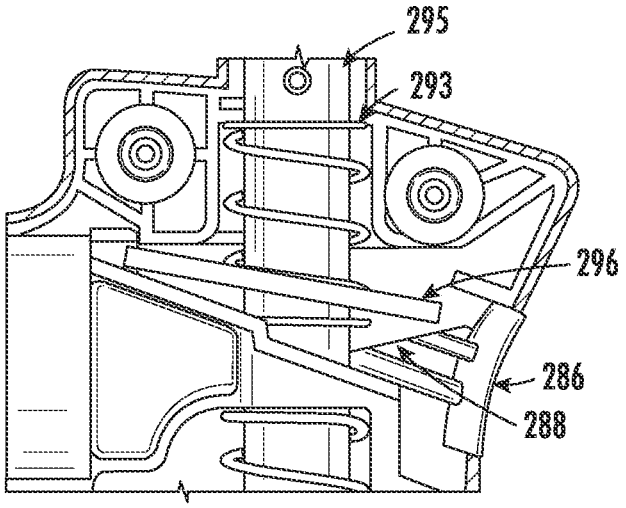
Figure 8:
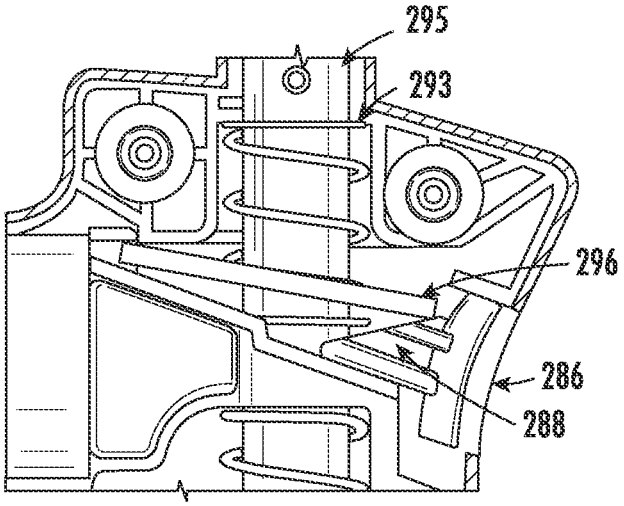

Referring now to FIGS. 6 through 8 where additional details of the clamp member 28 is provided, each clamp member comprises a housing 284 supporting a clamping actuator 285 and a releasing actuator 286 which control the movement of the extensible member 281 bi-directionally along extension axis 115. The clamping actuator 285 is biased toward a first position by spring 292. Movement of the clamping actuator 285 by a user is effected by grasping the actuator 285 and housing grip 287 and squeezing to pull actuator 285 upwardly. This motion pivots the actuator generally about fulcrum 294 which displaces jack plate 291 upwardly and angularly. The increased angular displacement of the jackplate 291 from a perpendicular alignment with jacking member 295 causes the jackplate 291 to engage the outer surface of the jacking member 295 and urge it upwardly toward the engaged position of the extensible member as the clamping actuator 285 is pulled upwardly. When the user releases pressure on the actuator it returns to its initial downward position by the biasing force of spring 292. Locking plate 296 engages the outer surface of the jacking member 295 as it moves. Upward movement of the jacking member 295 tends to reduce the angular deflection of the locking plate relative to the jacking member which allows upward movement thereof. Downward (reverse) movement of the jacking member is inhibited as the locking member angularity in relation to the jacking member increases thereby engaging the jacking member to prevent downward (dis-engaging direction) movement while the actuator 285 returns to its normal position. Repeated actuation of the clamping actuator 285 moves the extensible member 281 until it engages the lower surface (engaged position) of the table and applies a clamping force to retain the seat securely in place.

Releasing the grip of clamp member 28 is accomplished by depressing releasing actuator 286 inwardly in relation to the clamp housing 284. Movement of the releasing actuator 286 drives release cam 288 into contact with the locking plate 296, displacing one end upwardly and reducing the angularity of the locking plate 296 which allows downward (disengaging) movement of the jacking member. The locking plate 296 is biased toward its angled position by return spring 293. The jacking member 295 is urged into the disengaged position by the clamping force or by gravity when the locking plate is released.

Installing the seat requires a caregiver to first unfold the clamping arms 26 to their deployed positions and then position the seat on the table adjacent to an edge with the grip arms 22 resting on the upper surface of the table. The clamp members 28 will initially be in the removal orientation to allow the clamping frames to easily positioned beneath any obstructions on the underside of the table. Once so positioned, the clamp members can be rotated into the clamping orientation. The user then grips each clamp member to operate the clamping actuator 285 until the extensible member 281 moves upwardly and the gripping foot 282 is pressed against the lower side of the table (engaged position). Additional operation of the clamping actuator will apply a clamping force between the gripping foot 282 and the grip arms 22 to restrain the seat 10 in a stable position on the tabletop. The preferred embodiment includes two clamp members. Best results are obtained when the clamp members are simultaneously operated.

Figure 9:
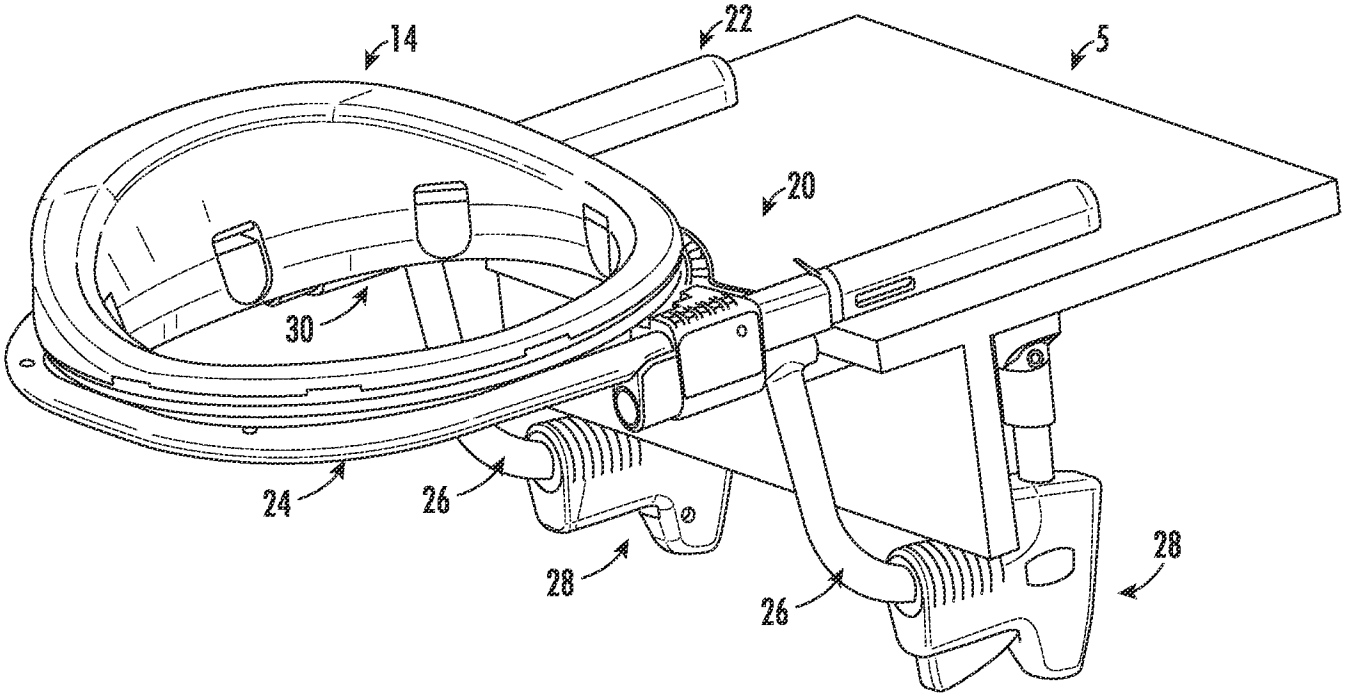
FIGS. 9 and 10 show the rotatable clip-on table seat configured with the seat portion oriented so that a child occupant in not facing the table to which the seat is attached.
Figure 10:
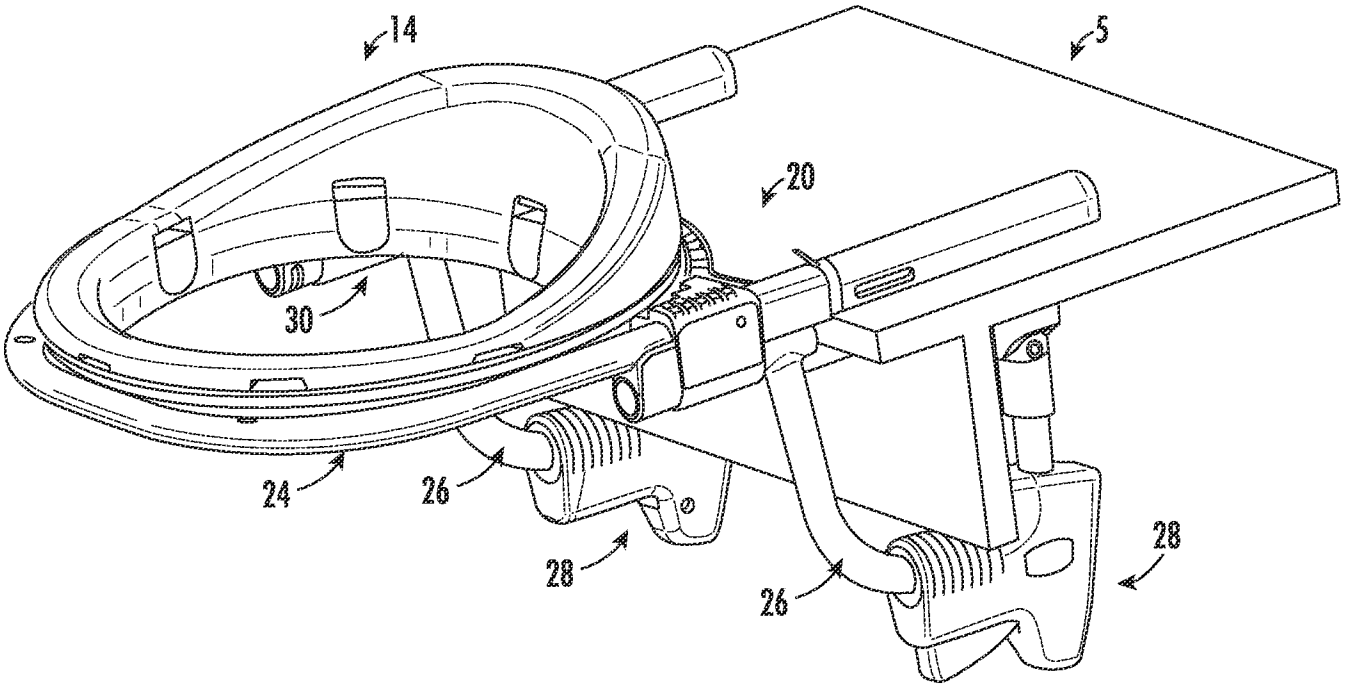

Referring to FIGS. 9 and 10, the seat 10 is shown with the seat support 14 rotated about a generally upstanding axis into side- and rear-facing orientations. A swivel mechanism 30 may be provided connecting the seat support 14 to the seat frame 24 that enables the seat support 14 to be rotated into one of a plurality of pre-determined orientations. These orientations allow the caregiver-user to orient the child occupant of the seat in forward-facing (FIGS. 1 and 2), side-facing (FIG. 9), or rear-facing (FIG. 10). The swivel mechanism 30 includes means to selectively restrain the seat support 14 in the desired orientation. Additional orientations may be included by configuring the selective restraining means to lock in the seat support to provide near-infinite orientations on the seat support.

The seat swivel mechanism 30 has a positioning mechanism preferably in the form of a spring biased detent that restrains the seat in one of the predetermined orientations. Changing orientations is accomplished by overcoming the force of the detent as the caregiver rotates the seat support 14. A release mechanism may be provided in the swivel mechanism 30 to allow the seat support 14 to be detached from the main frame 20.

A seat latch mechanism may also be provided to allow detachment of the seat frame 14 from the main frame 20 to allow easy access to the soft goods for cleaning or removal from the seat support 14. The seat latch mechanism may include a user-activated release actuator which, when activated, allows the user to lift and remove the seat support 14 from the main frame 20 for easy access to the soft goods for cleaning or removal from the seat support. Reinstallation of the seat support 14 requires simply pushing the seat support into position on the main frame. Cam surfaces on the bottom faces of the seat latch and the detent push them in until they snap onto the main frame.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

We claim:

1. A portable seat for attachment to a tabletop to support a child thereon, the portable seat comprising:

a main frame having a seat support and a distally opposed grip arm, the grip arm configured for positioning in adjacent contact with a top surface of the tabletop as the seat support is disposed cantilevered adjacent to an edge of the tabletop;

a clamping arm connected at a proximal end to the main frame and configured for rotatable movement about a longitudinal axis between opposing folded and unfolded positions, a distal end of the clamping arm extending beneath the tabletop when in the unfolded position; and a clamp member connected to the distal end of the clamping arm and configured for rotatable movement about a clamp axis between opposing first and second positions, the clamp axis being generally parallel to the longitudinal axis, the clamp member having an extensible member that is engageable with a lower surface of the tabletop when the clamp member is in the first position to secure the portable seat to the tabletop.

2. The portable seat of claim 1, wherein the clamp member comprises a clamping actuator to selectively cause movement of the extensible member toward an extended position.

3. The portable seat of claim 2, wherein the clamping actuator causes ratcheting movement of the extensible member toward the extended position, the clamp member further having a releasing actuator that, when actuated, allows movement of the extensible member away from the extended position.

4. The portable seat of claim 1, wherein the connection between the clamping arm and the main frame comprises a clamping arm connector with a biasing mechanism to restrain the clamping arm in the folded position or the unfolded position.

5. The portable seat of claim 4, wherein the biasing mechanism is a spring ball detent.

6. The portable seat of claim 1, further comprising a child seat connected to the seat support by a swivel mechanism, the swivel mechanism enabling the child seat to be rotated about an upstanding axis to selectively orient a child occupant in one of a plurality of orientations in relation to the tabletop.

7. The portable seat of claim 6, wherein the swivel mechanism includes a positioning mechanism that restrains the child seat in a selectable one of a plurality of orientations.

8. The portable seat of claim 6, wherein the child seat may be disconnected from the seat support.

9. A portable seat for attachment to a tabletop to support a child thereon, the portable seat comprising:

a main frame having a seat support and a pair of spaced-apart grip arms distally opposed and generally parallel to a longitudinal axis, the grip arms configured for positioning in adjacent contact with a top surface of the tabletop as the seat support is disposed cantilevered adjacent to an edge of the tabletop;

a pair of clamping arms connected at a proximal end to the main frame and configured for rotatable movement about a folding axis between opposing folded and unfolded positions, a distal end of the clamping arms extending beneath the tabletop when in the unfolded position; and a clamp member connected to the distal end of each clamping arm and configured for rotatable movement about a clamp axis between opposing first and second positions, the clamp member having an extensible member that is engageable with a lower surface of the tabletop when the clamp member is in the first position to secure the portable seat to the tabletop;

wherein the clamp axis and the longitudinal axis are substantially parallel enabling folding of the portable seat and positioning the clamping arms and the clamp members substantially between the grip arms.

10. The portable seat of claim 9, wherein the connection between the clamping arm and the main frame comprises a clamping arm connector with a biasing mechanism to restrain the clamping arm in the folded position or the unfolded position.

11. The portable seat of claim 10, wherein the biasing mechanism is a spring ball detent.

12. The portable seat of claim 10, wherein the clamp member comprises a clamping actuator to selectively cause movement of the extensible member toward an extended position.

13. The portable seat of claim 12, wherein the clamping actuator causes ratcheting movement of the extensible member toward the extended position, the clamp member further having a releasing actuator that, when actuated, allows movement of the extensible member away from the extended position.

14. The portable seat of claim 9, further comprising a child seat connected to the seat support by a swivel mechanism, the swivel mechanism enabling the child seat to be rotated about an upstanding axis to selectively orient a child occupant in one of a plurality of orientations in relation to the tabletop.

15. The portable seat of claim 14, wherein the swivel mechanism includes a positioning mechanism that restrains the child seat in a selectable one of a plurality of orientations.

16. The portable seat of claim 15, wherein the child seat is selectively detachable from the seat support.

* * * * *